United States Patent [19]

Mills

[11] Patent Number: 4,932,723

[45] Date of Patent: Jun. 12, 1990

[54] CUTTING-BIT HOLDING SUPPORT BLOCK SHIELD

[76] Inventor: Ronald D. Mills, 960 S. Jay Cir., Anaheim, Calif. 92807

[21] Appl. No.: 372,867

[22] Filed: Jun. 29, 1989

[51] Int. Cl.[5] ..... F21C 35/18

[52] U.S. Cl. ..... 299/86; 299/91

[58] Field of Search ..... 299/79, 86, 91

[56] References Cited

U.S. PATENT DOCUMENTS

| | | | |
|---|---|---|---|
| 3,512,838 | 5/1970 | Kniff | 299/86 |
| 3,778,112 | 12/1973 | Krekler | 299/86 |
| 4,489,986 | 12/1984 | Dziak | 299/86 |
| 4,660,890 | 4/1987 | Mills | 299/86 X |
| 4,818,027 | 4/1989 | Simon | 299/86 X |
| 4,844,550 | 7/1989 | Beebe | 299/86 X |

*Primary Examiner*—Jerome W. Massie
*Assistant Examiner*—David J. Bagnell
*Attorney, Agent, or Firm*—William L. Chapin

[57] ABSTRACT

A shield for improving the wear resistance and life of holding support blocks for cylindrical carbide-tipped cutting bits used in drum pulverizer and wheel machines of the type used for pulverizing and cutting refractory materials is disclosed. The shield includes a short cylindrical metal container having a bottom annular wall supporting a coaxial central tube section. The annular space between the tube and inner surface of the cylindrical wall of the container contains and is hard brazed to solid tungsten carbide segments in the shape of sectors of a flat annular ring whose upper surface is parallel to the upper annular wall surface of the outer cylindrical wall of the container. The bore of the central tube is adapted to receive the shank of a cutting-bit, and the bottom wall of the cylindrical container of the shield is welded to the face of a cutting-bit holding block, with the bores of holding block and tube aligned, to permit insertion and removal of cutting bits into the bore of the holding block. In the preferred embodiment, the upper end of the tube is coined to flare radially outwards and downwards over the inner circumferential edges of the carbide segments, retaining the segments in place in the container. Preferably, the entrance bore of the tube is tapered to form a rotational bearing surface for the tapered lower annular flange of a cutting-bit.

20 Claims, 3 Drawing Sheets

CUTTING-BIT HOLDING SUPPORT BLOCK SHIELD

BACKGROUND OF THE INVENTION

1. Field of the Invention

This invention relates to an article for improving the effectiveness of rotary drum or wheel trenching machines employing carbide-tipped cutting bits for pulverizing or trenching concrete, asphalt roadways and similar surfaces. More particularly, the invention relates to articles for protecting the support blocks, in which rotatable carbide cutting bits are mounted, from premature failure caused by impact and abrasion from pieces of pulverized material encountered during operation of the machines using the bits.

2. Description of Background Art

When concrete or asphalt roadways, aircraft runways, and the like require a trench opening, replacement or complete removal, a machine frequently employed for this purpose is a rotary drum pulverizer or wheel cutter. Typically, such machines utilize a large drum or wheel which has a diameter of two to ten feet, and a cutting width ranging from three inches to twelve feet. Welded to the outer circumferential surface of the drum or wheel are 60 to 300 or more steel support blocks which hold cylindrical, tungsten carbide-tipped cutting bits. The cutting bits extend radially outward from the circumferential surface of the drum. A typical rotary pulverizer drum or wheel is rotated by a 400 horsepower motor at a linear speed of 1,500 surface feet per minute.

The cutting bits used in many rotary pulverizers are elongated, solid cylinders, typically 3½" long by ¾" in diameter at the shank end. The outer or top face of the cylinder typically has a conical-shaped tungsten carbide tip brazed to it. The shank of each cutting-bit is held within a longitudinally disposed bore in a separate forged steel support block welded to the circumference of the pulverizer drum or wheel. Approximately one-half of the length of the bit extends outward from the top, upper transverse face of the holding block. Each cutting-bit is secured in its support block with a clip or sleeve that permits the cutting-bit to rotate freely about its cylindrical axis. This permits the bit to be rotated by tangential frictional contact with the material which it is cutting. As a result of rotation of the bit, wear of the bit is more evenly distributed, extending the useful life of the bit. U.S. Pat. No. 4,201,421 discloses a split sleeve for rotatably mounting cutting bits in their support blocks.

Although providing the capability for free rotation of the cutting-bit results in more uniform wear and extended life of the bit, wear of the bit support block continues to be a problem. The flat, upper transverse face of the bit support blocks is continuously impacted with abrasive materials during the operation of the rotary drum pulverizers or wheel machines. Also, if a bit wears down to the extent that it extends only a short distance out from the face of its support block, more rapid and destructive wear of the support block occurs. Excessively worn bit-support blocks must be removed from the pulverizer drum or wheel with a cutting torch, and a new support block welded onto the drum or wheel. This replacement process is time consuming, and therefore, costly. Furthermore, it frequently happens that replacement of support blocks under field conditions results in a misalignment of the bore axis of the holding support block from its optimum orientation, decreasing the effectiveness of machine operation.

To alleviate the problem of cutting-bit holding block wear, I introduced in October of 1983 an accessory which I referred to as the "Spin-Shield." This accessory is comprised essentially of a flat, hardened steel annular ring or washer which is adapted to fit between the enlarged base of a cylindrical cutting bit, and the transverse outer face of the support holding block which rotatably supports the bit. In addition to absorbing wear which would otherwise be experienced by the bit holding block, my "Spin-Shield" provided other advantages. One such advantage is the separation provided between the cutting-bit chamfer and the bit support holding block, preventing the formation of a bur on the inside of the bore of the holding block. Another advantage is the reduction of cutting-bit friction, allowing the cutting-bit to rotate more freely. This results in cooler operation and more even wear of the cutting-bit, substantially extending its life.

Subsequent to my introduction of the "Spin-Shield" bit holding support block protector, I observed in the field a cutting-bit with a bell-shaped integral flange near the middle of the forged bit shank. The apparent purpose of the bell-shaped flange was to achieve in a limited way some of the advantages of my "Spin-Shield."

After developing my "Spin-Shield," I devised a "Pulverizer Cutting Bit Shield" to protect holding blocks for cylindrical cutting bits from excessive wear. That cutting-bit comprised an annular steel ring shaped like an inverted dish with a central hole and a substantially curved, convex upper surface The ring is adapted to being attached coaxially over the upper portion of the cutting-bit into the bottom entrance of the central hole. The upper surface of the ring is then pounded down on the shank until it abuts an upper annular flange onto the shank of the bit, and is retained in position by a tight interference fit between the outer diameter of the shank and the inner diameter of the ring.

The pulverizer cutting-bit shield described above is an effective means for protecting cutting-bit holding blocks from excessive wear. Moreover, the rotation of the pulverizer cutting-bit in unison with the shield fixed to its shank is particularly effective in applications where it is desired to mix material such as soil impacted by the cutting-bit.

However, I have found that for some applications of pulverizer cutting bits, it would be desirable to have a freely rotatable cutting-bit shield. In particular, for those applications of pulverizer cutting bits in which high impact forces and/or highly abrasive materials are encountered, a freely rotating bit shield would be better because normal wear is distributed evenly on the cutting-bit, thereby extending the useful life of the bit.

Accordingly, I developed a novel and highly effective rotatable cutting-bit shield, which resulted in the issuance to me of U.S. Pat. No. 4,660,890, Apr. 28, 1987, "Rotatable Cutting Bit Shield." Field testing of the aforementioned rotatable cutting-bit shield has proven it to be highly effective in protecting the faces of holding support blocks in which cutting bits fitted with the rotating shield are installed from premature failure. For some applications, however, it would be desirable to provide additional means for protecting cutting-bit support holding blocks, in which a variety of conventional cutting bits may be mounted. With that goal in mind, I conceived of alternate protective structures which could be fastened to the outer transverse face of cutting-bit holding support blocks.

The purpose of these structures would be to protect the hardened steel holding support block from abrasion and impact damage of concrete pieces, rocks, pieces of pavement, etc. brought into abrading impact with the holding support blocks during the pulverization or cutting process.

To accomplish its intended function, a pulverizer cutting-bit holding support block face protector must possess two characteristics: (1) It must be very hard, to resist abrasion wear and damage; and (2) It must withstand high impact forces without shattering.

In the past, hardened steel rings have been attached to the outer transverse faces of cutting-bit holding support blocks, to decrease wear rates of the holding support blocks. Hardened steel shield rings are relatively easy to attach to steel cutting-bit holding block faces, by welding. Moreover, hardened steel rings of the appropriate hardness (Rockwell 40 or higher) have very good resistance to shattering by impacting objects. However, many of the materials being cut which are encountered in the normal operation of a pulverizer have a higher surface, or Moh's scale, hardness than hardened steel. Such hard materials will quickly wear down the surface of a hardened steel shield ring, limiting the effectiveness of hardened steel as a shield material. Steel protection rings with greater hardness, above 50 Rockwell, tend to shatter when encountering normal high impact forces.

With these limitations in mind, I experimented with shield rings fabricated from tungsten carbide, reasoning that the carbide, being harder than all materials normally encountered in the operation of a pulverizer, would afford acceptable abrasion resistance.

As predicted, the carbide shield rings which I fabricated and attached to the faces of cutting-bit holding blocks provided excellent abrasion resistance properties. The carbide holding block shield rings which I tested required more development to solve the problem of holding support block wear, for the following reasons.

First, the attachment of a fixed carbide shield ring to a steel holding support block requires high localized heating of both the ring and block to a very high temperature, typically over 1,500° F. This high temperature causes the whole holding block to become annealed, resulting in a substantial reduction in surface hardness, and a corresponding diminution in abrasion resistance of the portion of the holding support block not covered by the carbide shield ring. Also, the strength of the support holding block is lowered as a result of being heated to a high temperature in a localized area.

A second problem encountered in attempting to use solid carbide rings as holding block shields results from the large difference in the coefficients of thermal expansion for carbide and steel, respectively. Thus, steel, having a coefficient of thermal expansion approximately eight times greater than that of carbide, builds up large stresses in an attached carbide ring, when the two materials are heated and cooled while being attached to one another. These large stresses ultimately can result in cracks causing fracturing and early catastrophic failure of shield rings fabricated from solid carbide.

In addition to the drawbacks described above of using holding support block shield rings fabricated from solid carbide, the carbide itself has low impact resistance. Thus, solid carbide shield rings are subject to breaking upon being impacted by pulverized pieces of rock, concrete or the like, of sufficient size and kinetic energy.

Having encountered the above-described problems in providing cutting-bit holding support block protection by means of solid carbide shields, I undertook to devise a more satisfactory solution to the problem of protecting cutting-bit holding support blocks.

One such cutting-bit holding block shield which I devised and tested consisted of an annular cup-shaped hardened steel container filled with a composite material consisting of tungsten carbide chips held in a german-silver matrix. This shield showed early promise in the laboratory testing. However, field testing under the much more severe conditions encountered in the actual use of pulverizing machines revealed shortcomings of the composite shield. The malleability of the softer matrix material caused it to peen under rock impact. This caused the matrix material within the annular steel container to flow radially inwards and outwards under repeated impacts, buckling the container walls and causing early failure of the shield. Even case hardening the steel container did not solve the problem. Hardened steel washers were used in various combinations with the composite-filled container, but did not significantly increase the wear life of the shield. Accordingly, a new approach to the problem was conceived of.

OBJECTS OF THE INVENTION

An object of the present invention is to provide an efficient means for protecting holding support blocks, of the type used to hold cutting bits used in pulverizer and rotary drum or wheel machines, from excessive abrasion and impact damage.

Another object of the invention is to provide a wear-reducing shield for cutting-bit holding support blocks.

Another object of the invention is to provide a cutting-bit shield for cutting-bit holding support blocks which has both great hardness for providing high abrasion resistance, and high impact strength to resist breakage.

Another object of the invention is to provide a shield for cutting-bit holding support blocks which is easily and quickly attachable and removable from the face of a cutting-bit holding block, permitting convenient field replacement when necessary.

Another object of the invention is to provide a shield for cutting-bit holding blocks which may be attached and removed from a holding block at relatively modest temperatures, thereby assuring that neither the attachment nor removal process will significantly reduce the temper and hardness of the holding support block.

Another object of the invention is to provide a shield for cutting-bit holding support blocks which may be used effectively with a wide variety of cutting bits, with or without annular shield means incorporated into the bits.

Another object of the invention is to provide a universal shield which may be attached to a wide variety of cutting-bit holding support blocks.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiment described. I do intend that equivalents, adaptations and modifications reasonably inferable from the invention described herein be included within the scope of the invention as defined by the appended claims.

SUMMARY OF THE INVENTION

Briefly stated, the present invention comprehends a shield for placement on the outer transverse face of a cutting-bit holding support blocks used in drum pulverizers and wheel machines to pulverize or cut refractory materials such as concrete. The purpose of the shield is to protect the holding block from impact and abrasion damage, while not interfering with the function of the carbide-tipped cutting-bit installed in the holding block.

The cutting-bit holding block shield according to the flat annular ring having a central bore at least as large as the bore in holding block intended for receipt of the shank of a cutting-bit.

The annular ring includes an annular cup-shaped steel container having an open top and a hollow central tube section extending upwards from the flat bottom annular wall of the container. The annular space between the outer cylindrical wall surface of the central tube section and the inner cylindrical wall surface of the outer cylindrical wall contains solid tungsten carbide segments. The carbide segments are in the shape of sectors of a flat annular ring whose upper surface is parallel with the upper annular wall surface of the outer cylindrical wall of the container. Taken together, the carbide segments form an annular-shaped ring, but with slight gaps between adjacent radial faces of each pair of adjacent segments.

The hollow central tube section of the steel container holding the tungsten carbide segments is flared radially outwards and downwards over the inner circumferential edges of the segments, retaining the segments in place while they are nickle brazed to the inner surfaces of the container during the fabrication of the shield. Flaring the upper end of the tube also produces a tapered entrance bore adapted to rotationally seat the tapered lower annular flange of a standard cutting-bit.

Installation of the cutting-bit shield is performed by welding the outer annular edge of the bottom wall of the steel container to the upper transverse face of a cutting-bit holding block with a mild steel welding rod. In fastening the shield ring to a holding support block, the central bore of the shield is coaxially aligned with the central bore of the holding support block. This alignment is effected by inserting a cutting-bit through the bore of the shield and into the bore of the holding block.

BRIEF DESCRIPTION OF THE DRAWINGS

FIGS. 6A through 10A and 6B through 10B show side and end elevation views, respectively, of the shield of FIG. 1 installed on 5 different styles and types of typical holding support blocks in common use on drum pulverizing and wheel machines.

DETAILED DESCRIPTION OF THE INVENTION

Figure 1:
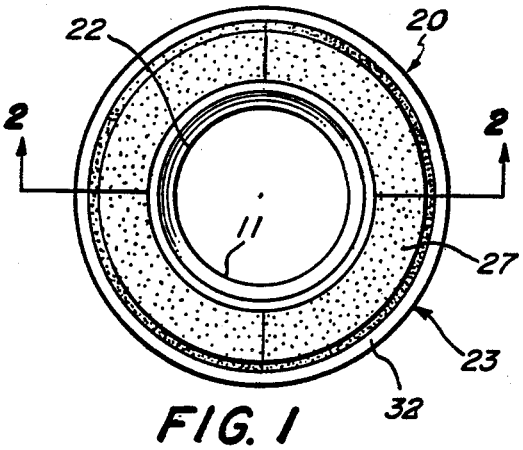
FIG. 1 is an upper plan view of the novel cuttingbit holding support block shield according to the present invention.
Figure 2:
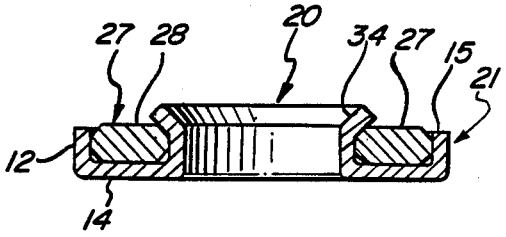
FIG. 2 is a longitudinal mid-sectional view of the shield of FIG. 1, taken along the 2—2 that Figure.

Referring now to FIG. 1, a top plan view of a novel cutting-bit holding block shield 20 according to the present invention is shown. FIG. 2 is a longitudinal mid-plane sectional view of the shield 20. A detailed understanding of the novel and advantageous aspects of the cutting-bit holding block shield according to the present invention may be facilitated by a description of the process of manufacturing the shield, which description follows.

FIGS. 3(*a–h,j–n,p*) illustrate a process for manufacturing a novel cutting-bit holding block shield according to the present invention. In the process of fabricating a cutting-bit holding block shield 20 according to the present invention, as illustrated in FIGS. 2 and 3, an annular disk 21 of 1045 steel having a thickness of about 0.062 inch is first formed, preferably, by stamping. For one particular size cutting-bit shield, disc 21 has an O.D. of 1.880 inch and a central hole of 0.840 inch diameter.

Figure 3A:
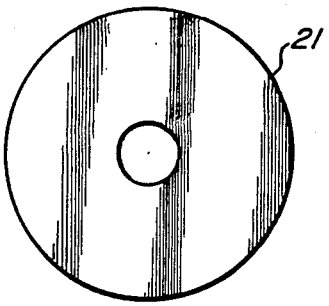
FIGS. 3(*a–h,j–n,p*) illustrate the steps performed in fabrication of the shield of FIG. 1.
Figure 3B:
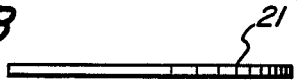
Figure 3C:
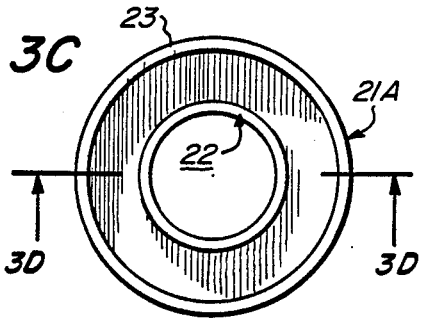
Figure 3D:
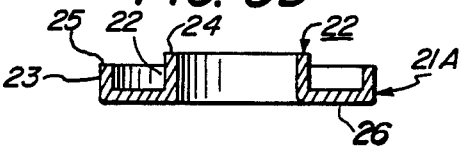

FIG. 3A is a plan view of the steel blank 21 and FIG. 3B is an edge view of the blank. The first step in forming a shield 20 from a blank 21 is to deep draw the disc-shaped blank into an annular cup-shaped ring 21A, as shown in FIGS. 3C and 3D. This cup-shaped annular ring 21A has a central tube section 22 and an outer cylindrical section 23, having parallel vertical walls 24 and 25 respectively, and a flat annular bottom wall 26. At this stage of the fabrication process, the central tube section 22 has a greater height than outer cylindrical section 23.

Figure 3E:
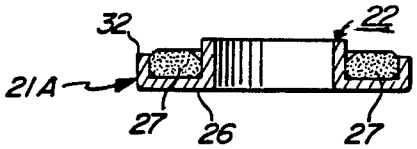
Figure 3F:
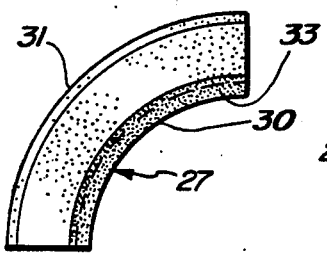
Figure 3G:
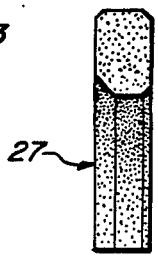

The next step in fabricating cutting-bit shield 20 includes placing carbide segments 27 onto the upper surface of the bottom annular wall 26 of the cup-shaped ring 21A, as shown in FIG. 3E. As shown in FIGS. 3E, 3F, 3G and 3H, the carbide segments have the general shape of sectors of an annular ring having flat and parallel upper and lower annular faces 28 and 29, respectively.

Figure 3H:
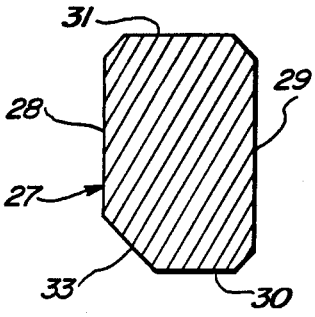
Figure 3J:
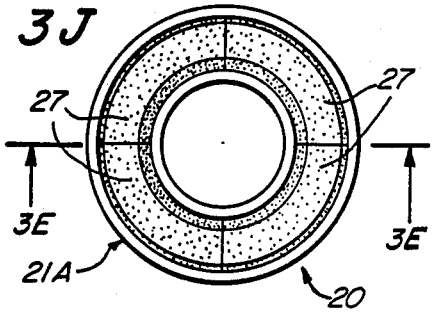

As may be seen best by referring to the transverse sectional view of FIG. 3H, the upper and lower annular surfaces 28 and 29 are chamfered at their intersections with the inner and outer, parallel arcuate side walls 30 and 31, respectively, of the segments 27. As shown in FIG. 3J, sufficient identically shaped segments 27 are placed in the cup-shaped of approximately 0.005 inch are provided between adjacent radial faces of adjacent rings, for a reason to be described below. The preferred number of carbide annular sector-shaped segments 27 is four sectors, each having a ninety-degree arc length. Optionally, two one-hundred-and-eighty-degree sectors, six sixty-degree sectors, or other combinations may be used. The preferred material for segments 27 is a composition containing 89% tungsten carbide and 11% cobalt.

As shown in FIG. 3E, the thickness of carbide segments 27 is of the proper value to place the upper annular face 28 of the segments in parallel alignment with the upper annular face 32 of outer cylindrical section 23 of the cup-shaped ring 21A. Preferably, the upper annular faces 28 of segments 27 lie in a plane displaced upwards slightly from the plane of annular face 32.

Figure 3K:
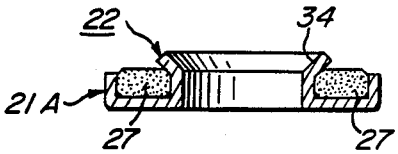
Figure 3L:
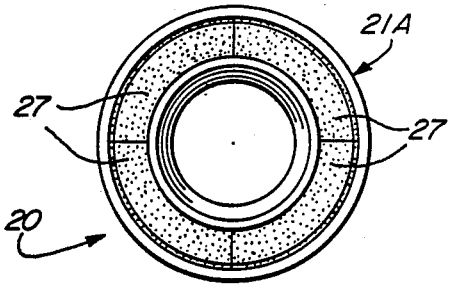

The next step in fabricating shield 20 consists of coining the upper portion of the central tube section 22 to flare downwards and outwards, as shown in FIG. 3K. The outward radial extension of the upper end of the central tube section 22 resulting from this coining operation is sufficient to contact the upper, inner chamfered annular surface 33 of segments 27, thus holding the segments in place within the cup-shaped ring 21A. Coining the upper end of central tube section 22 also produces a chamfered entrance bore surface 34, the utility of which will be described below.

Figure 3M:
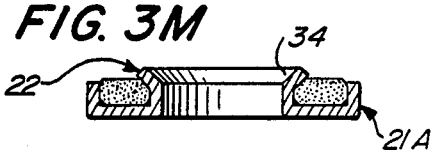

After the carbide segments 27 have been captivated within the cup-shaped ring 21A, the segments are brazed to the inner wall surfaces of the ring, as indicated in FIG. 3M, using an AMS 4777 nickle-chromium brazing paste. That brazing material was selected after testing revealed that conventional copper brazing did not provide a strong enough joint between the segments and case, resulting in segments being dislodged from the case during use. The steel case 21 is then carburized to harden it. Alternatively, the blank 21A from which the steel case 21 is formed may be made of 1045 high carbon steel. This material needs only to be heat treated, rather than carburized, to give it the required hardness of about 40 Rockwell.

Figure 3N:
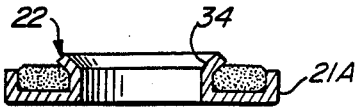
Figure 3P:
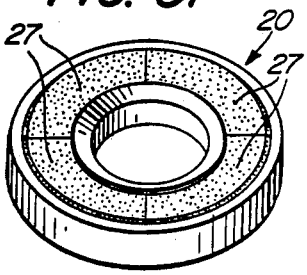
Figure 6A:
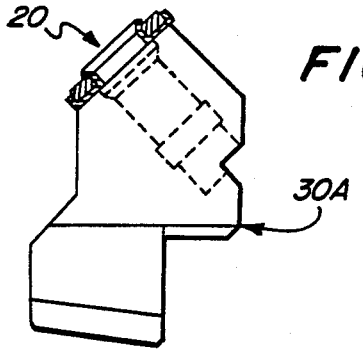
Figure 6B:
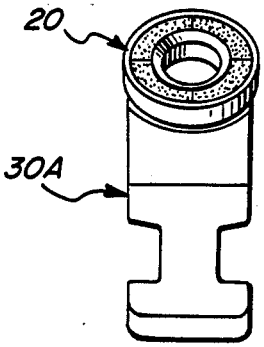
Figure 7A:
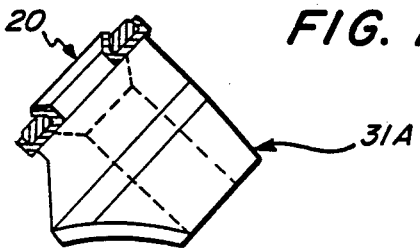
Figure 7B:
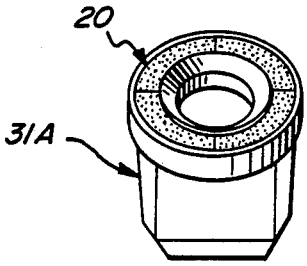
Figure 8A:
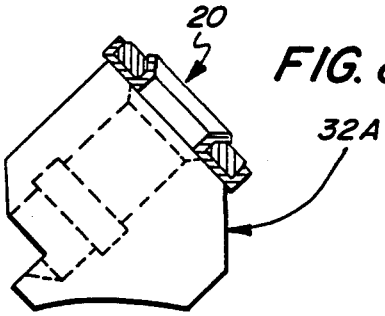
Figure 8B:
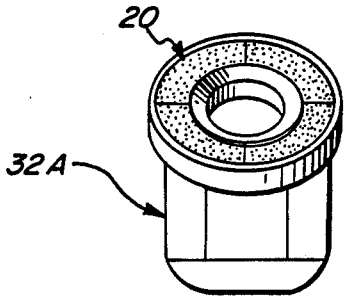
Figure 9A:
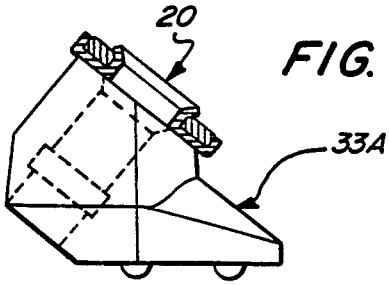
Figure 9B:
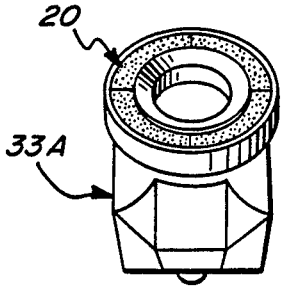
Figure 10A:
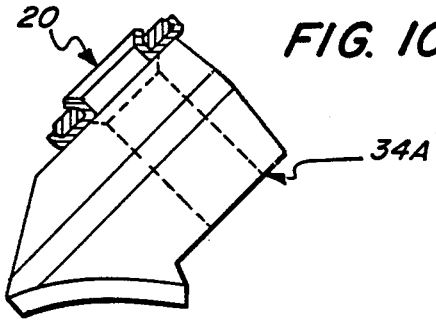
Figure 10B:
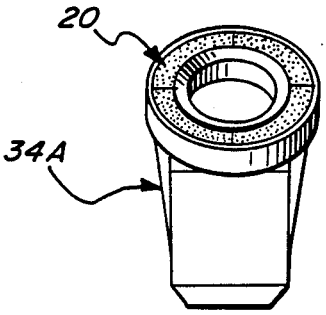

After the carburization or heat treating of case 21, the shield is annealed as indicated in FIG. 3N at 700° for about 7 hours to eliminate any embrittlement of the steel which may have been caused by the high temperatures of the carburizing or heat treating step. This is the final step in fabricating a complete shield assembly, indicated in perspective view in FIG. 3P.

Figure 4:
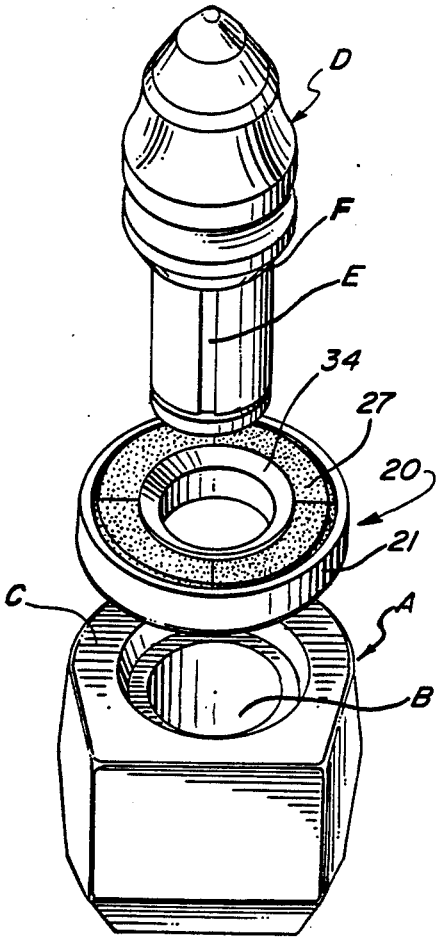
FIG. 4 is an exploded perspective view, showing the shield of FIG. 1 preparatory to its installation on a typical holding support block, and showing a cutting-bit adapted to be held by the holding block.
Figure 5:
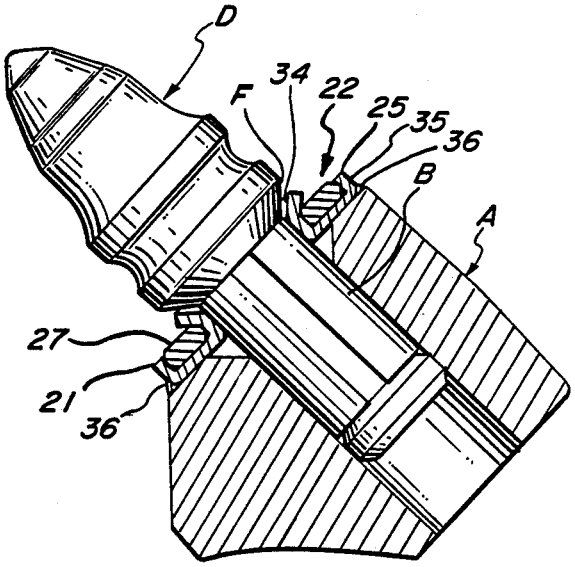
FIG. 5 is a partially sectional side view of the holding block, shield, and cutting-bit of FIG. 4, showing the shield welded to the holding block, and a cutting-bit held therein.

The method of attachment of the novel cutting-bit holding block shield 20 according to the present invention to holding block A is shown in FIGS. 4 and 5.

As shown in FIG. 4, the finishing shield 20 is positioned coaxially over the bore B of a holding block A, with the upper faces 28 of the carbide segments 27 facing upwards, away from the upper transverse face C of the holding block. Also, as shown in FIG. 4, the shank E of a cutting-bit D is positioned coaxially above the bore B of the holding block A. Then, as shown in FIG. 5, the shank E of cutting-bit D is forcibly inserted into bore B of the holding block A, in the conventional manner of mounting a rotatable cutting-bit in its holding block. With the shank E of the cutting-bit D inserted into the bore B of the holding block A, the shield is forced into coaxial alignment with the bore, as shown in FIG. 5. Thus positioned, the outer cylindrical wall 35 of outer cylindrical section 23 of shield 20 may be welded with a mild steel welding rod to the upper outer edge of the upper transverse face C of the holding support block A, the welds being indicated generally by the numeral 36.

With the cutting-bit holding block shield 20 fastened to a holding block A as shown in FIG. 5 and described above, cutting-bits D may be removed and replaced in the holding support block as readily as in holding support blocks not equipped with a shield.

The novel holding block shield 20 according to the present invention provides a very effective means for protecting the holding block A on which it is installed from abrasion and impact damage, thereby substantially increasing the useful life of the holding block. How it does so will now be described.

The very hard surfaces of the upper faces 28 of the tungsten carbide segments are extremely resistant to the abrasive wearing effects of detrital refractory material encountered in the operation of drum pulverizer and wheel machines. Also, the chamfered entrance bore surface 34 of central tube section 22 of the shield 20 provides a self-centering bearing surface for the tapered lower annular flange surface of cutting-bit D to be rotatably supported on.

The enormous forces encountered by the holding block and cutting-bit in breaking concrete, stone or other such refractory materials would quickly fracture a carbide shield ring in which there were pre-existing stress cracks. Thus, even microscopic cracks caused by differential thermal expansion and contraction of a carbide ring relative to a steel support, formed in brazing the two together, would quickly grow into large fractures under actual operating conditions. This would make a shield useless after a very short period of field operation. However, the relatively short arc lengths of the carbide segments 27 of the novel shield 20, in conjunction with the circumferential end gaps between adjacent radial surfaces of adjacent segments, permits heating and cooling the shield assembly without the formation of such failure-inducing stress cracks.

In operation of the novel cutting block shield 20, the upper end of the central tube section 22 having the chamfered entrance bore 34 can wear down after a relatively short period of operation. This wear-down occurs even though the tube section 22 along with the entire cup-shaped ring is made of very hard, heat treated steel, owing to the severely abrasive environment in which a pulverizer or cutting wheel works. When the tube section 22 wears down, the chamfered annular surface 33 on the upper inner edges of carbide segments 27 provides a new bearing surface for flange surface F of cutting-bit D.

In field tests of the novel cutting-bit holding block shield 20 according to the present invention, it was found that the upper annular transverse face 32 of outer cylindrical section 23 of the shield would wear down after about 200 hours of use to a height of approximately 0.125 inch below the upper surface 28 of the carbide segments 27. At this point, the upper surface 28 had assumed a shiny appearance. Further operation of test shields resulted in no substantial further wear of the outer cylindrical section 23 of the shield 20, or of the carbide segments 27 contained therein.

When a cutting-bit holding support block shield of the type described has been substantially worn by abrasion and impact, it can be easily replaced. Thus, when the thickness dimension of the shield ring 20 has been worn down to the point that continued operation of the pulverizer machine might expose the underlying face C of the holding block A, the worn shield ring should be removed and replaced with a new shield ring. This removal and replacement of the shield ring 20 is readily accomplished in the field by first removing the cutting-bit by conventional means, severing the welds 36 holding the shield ring 20 to the holding block with a cutting torch, and installing a new shield ring in the manner described above. The removal and replacement of the shield ring 20 on a holding support block is a much less demanding and costly operation than replacing a failed holding support block itself. Thus, protecting and extending the useful life of holding blocks by the use of the novel shields according to the present invention results in very significant cost savings to the operators of pulverizer machines and wheel machines.

FIGS. 6A through 10A are side elevation views of a variety of types of holding blocks 30A through 34A, showing the method of attachment of the novel cutting-bit holding block shield 20 to each type of holding block. FIGS. 6B through 10B are end views of the holding blocks 30A through 34A, each having an attached cutting-bit shield 20.

What is claimed is:

1. A shield for reducing wear rates of drum pulverizer and trenching machine holding support blocks of the type having a bore adopted to receive and hold the shank of a cylindrical cutting-bit comprising;

a. a cup-shaped shell of generally circular transverse cross-sectional shape having a coaxial central hole disposed through the thickness dimension of said shell, the diameter of said hole being at least as large as the diameter of said bore in said holding block, and b. an annular ring of abrasion resistant material contained coaxially within said cup-shaped shell, the inner diameter of said annular ring being at least as large as the inner diameter of said hole in said shell, and the thickness of said ring being approximately the same as the thickness of said shell.

2. The shield of claim 1 wherein said annular ring of abrasion resistant material comprises a plurality of segments of an annulus, each of said segments having a pair of radial faces, each of which is adjacent the radial face of another of said segments.

3. The shield of claim 2 wherein said annular segments are made of tungsten carbide.

4. The shield of claim 3 wherein each of said annular segments is separated from an adjacent annular segment by a circumferential gap between adjacent radial faces of said segments.

5. The shield of claim 1 wherein said cup-shaped shell is made of steel.

6. A shield for reducing wear rates of drum pulverizer and trenching machine cutting bit holding support blocks of the type having a bore extending longitudinally inwards from an outer transverse face of the holding block, said bore being adapted to receive and hold the shank of a cylindrical cutting-bit, said shield comprising;

a. a relatively thin, cup-shaped shell having a cylindrical outer wall, a flat annular bottom ring forming the bottom wall of said shell, and a hollow central tube section extending coaxially upwards from the inner circumferential surface of said annular bottom ring, the height of said hollow central tube section being somewhat greater than the height of said outer cylindrical wall of said shell, thereby forming a hollow annular space between the upper surface of said flat annular bottom ring, the outer cylindrical surface of said central tube section, and the inner cylindrical surface of said outer cylindrical wall, and b. an annular ring of abrasion resistant material contained coaxially within said cup-shaped shell, the inner diameter of said annular ring being at least as large as the outer diameter of said hollow central tube section, and the thickness of said ring being of the proper value to locate the upper annular surface of said ring parallel and close to the upper annular surface of said outer cylindrical wall.

7. The shield of claim 6 wherein said annular ring of abrasion resistant material comprises a plurality of segments of an annulus, each of said segments having a pair of radial faces, each of which is adjacent the radial face of another of said segments.

8. The shield of claim 7 wherein each of said annular segments is separated from an adjacent annular segment by a circumferential gap between adjacent radial faces of adjacent annular segments.

9. The shield of claim 8 wherein said annular segments are made of tungsten carbide.

10. The shield of claim 9 wherein the upper end of said hollow central tube section is flared outwards and downwards to form an annular contact zone with the upper surfaces of said annular segments adjacent the outer cylindrical wall of said central tube section.

11. The shield of claim 10 wherein each of said annular segments has at the intersection of its upper annular face and its inner arcuate bore wall a chamfered surface adapted to be conformally contacted by the downwardly and outwardly flared outer cylindrical wall of said hollow central tube section.

12. The shield of claim 11 wherein each of said annular segments has at the intersection of its lower face and its inner arcuate bore wall a chamfered surface.

13. The shield of claim 12 wherein each of said annular segments as at the intersection of its outer arcuate wall surface and its upper and lower annular faces chamfered surfaces.

14. The shield of claim 9 wherein the upper entrance bore of said hollow central tube section is chamfered so as to provide a self-centering bearing surface for the tapered lower annular flange surface of a cutting-bit.

15. The shield of claim 9 wherein said plurality of annular segments is defined as comprising two substantially identical annular segments, each having an annular arc length of slightly less than 180 degrees.

16. The shield of claim 9 wherein said plurality of annular segments is defined as comprising three substantially identical annular segments, each having an annular arc length of slightly less than 120 degrees.

17. The shield of claim 9 wherein said plurality of annular segments is defined as comprising four substantially identical annular segments, each having an annular arc length of slightly less than 90 degrees.

18. The shield of claim 9 wherein said cup-shaped shell and said hollow central tube section are integrally formed from a single piece of sheet steel.

19. A shield for reducing wear rates of drum pulverizer and trenching machine cutting-bit holding support blocks of the type having a bore extending longitudinally inwards from an outer transverse face of the holding block, said bore being adapted to receive and hold the shank of a cylindrical cutting-bit having an upwardly and outwardly tapered lower annular flange surface formed on said shank, said shield comprising;

a. a relatively short, cup-shaped shell having a cylindrical outer wall, a flat annular bottom ring forming the bottom wall of said shell, a hollow central tube coaxial with said cylindrical outer wall extending longitudinally upwards from the inner circumferential surface of said annular bottom ring, the upper end of said hollow central tube section being flared outwards and downwards to form an upwardly and outwardly flared lower annular contact zone, and an outwardly flared upper annular wall surface adapted to provide a self-centering bearing surface for said lower annular flange surface of said cutting-bit, and b. a plurality of abrasion-resistant segments of an annulus having generally flat and parallel upper and lower surfaces, said segments having a thickness approximating that of the outer height of said cylindrical shell, said segments being disposed coaxially between the inner cylindrical wall surface of said cylindrical outer wall and the outer cylindrical wall surface of said hollow central tube section so as to form an annular ring having circumferential gaps between adjacent radial end walls of adjacent annular segments, the upper faces of said annular segments being restrained from upward longitudinal movement by said lower annular contact zone of said flared upper end of said hollow central tube section.

20. The shield of claim 19 wherein said abrasion resistant segments are made of tungsten carbide.

* * * * *